US008869449B2

(12) United States Patent
El Fassi et al.

(10) Patent No.: US 8,869,449 B2
(45) Date of Patent: Oct. 28, 2014

(54) SAFETY APPARATUS FOR CLOSING AND OPENING A DOOR

(75) Inventors: Said El Fassi, Vigneux sur Seine (FR); Clara Nogueira Alves, Issy les Moulineaux (FR)

(73) Assignee: Siemens S.A.S., St. Denis (FR)

( * ) Notice: Subject to any disclaimer, the term of this patent is extended or adjusted under 35 U.S.C. 154(b) by 0 days.

(21) Appl. No.: 13/637,418

(22) PCT Filed: Apr. 28, 2010

(86) PCT No.: PCT/EP2010/055699

§ 371 (c)(1), (2), (4) Date: Nov. 30, 2012

(87) PCT Pub. No.: WO2011/116836

PCT Pub. Date: Sep. 29, 2011

(65) Prior Publication Data

US 2013/0125468 A1 May 23, 2013

(30) Foreign Application Priority Data

Mar. 26, 2010 (EP) ..... 10290161

(51) Int. Cl.

*E05F 15/02* (2006.01)
*E05F 15/20* (2006.01)
*E05F 15/00* (2006.01)

(52) U.S. Cl.

CPC ..... *E05F 15/0013* (2013.01); *E05Y 2900/51* (2013.01); *E05F 15/2023* (2013.01); *E05F 15/0021* (2013.01); *E05F 15/0026* (2013.01); *E05F 15/0004* (2013.01); *E05Y 2900/531* (2013.01)

USPC ..... 49/26; 49/28

(58) Field of Classification Search

USPC ..... 49/25, 26, 28; 318/266, 466

See application file for complete search history.

(56) References Cited

U.S. PATENT DOCUMENTS 5,387,768 A * 2/1995 Izard et al. ..... 187/392
5,410,149 A * 4/1995 Winston et al. ..... 250/221
6,973,998 B2 * 12/2005 Deplazes et al. ..... 187/316

(Continued)

FOREIGN PATENT DOCUMENTS

FR 2829755 A1 3/2003
WO 01/42120 A1 6/2001
WO 02/44505 A1 6/2002
WO 2008071601 A1 6/2008

*Primary Examiner* — Katherine Mitchell
*Assistant Examiner* — Abe Massad
(74) *Attorney, Agent, or Firm* — Laurence A. Greenberg; Werner H. Stemer; Ralph E. Locher

(57) ABSTRACT

An apparatus automatically closes and opens a door in a frame. The door is controlled by a controller providing a safety mode for retaining the door in an open state and, if need be, a door reopening mode if an obstacle blocks the closure of the door. A camera having a vision axis intersecting a plane of the frame, provides an image of a space divided by the plane of the frame. An image analysis unit isolates the regions of interest of an obstacle in the space. A calculator extracts a geometrical characteristic of each region of interest, for classifying the same into a closest category of different safety scenarios of known characteristics, and for outputting, to the controller, a safety signal which activates the safety mode and which is dependent on the evaluation of a safety alarm value calculated by a formula, in accordance with the category.

14 Claims, 1 Drawing Sheet

(56) References Cited

U.S. PATENT DOCUMENTS 7,031,525 B2 * 4/2006 Beardsley ..... 382/199
7,522,745 B2 * 4/2009 Grasso et al. ..... 382/103
7,623,674 B2 * 11/2009 Nichani et al. ..... 382/103
2001/0045327 A1 11/2001 Shemanske, II et al.
2003/0218542 A1 * 11/2003 Barendt ..... 340/545.1
2009/0108987 A1 * 4/2009 Shikai et al. ..... 340/3.1

* cited by examiner

SAFETY APPARATUS FOR CLOSING AND OPENING A DOOR

BACKGROUND OF THE INVENTION

Field of the Invention

The present invention principally concerns an apparatus for automatically closing and opening at least one door in a frame in accordance with the claims.

The prior art of the present invention is based on an apparatus for automatically closing and opening at least one door in a frame, said door being controlled by a controller providing a safety mode for retaining the door in an open state and, if need be, a door reopening mode in the event of an obstacle blocking the complete closure of the door into the frame.

By way of a concrete example, the invention will use as an example a platform screen door of a public transportation vehicle such as that provided in a subway train which can present a real danger during passenger transit if said apparatus is not equipped with a reliable safety mode. Of course, the invention is not limited to this example, but serves any type of automatic door and their automatic closing and opening apparatus, such as in a building for example.

When a passenger with reduced mobility (for example, using a wheelchair) or an adult pushing a stroller enters a train via the automatic door, sudden closure of the door following the announced departure of the train will, if the embarkation area is not cleared in time, cause the edges of the doors to crush the passenger, the stroller and any accompanying obstacles or objects, which may prove extremely dangerous in certain cases. Another danger may occur when an object held by a passenger is located outside the vehicle when the door is closing while the passenger is inside the carriage or, vice versa, when the object is inside and the passenger is still outside the vehicle, the two being attached. Examples include a (dog) leash held by a person or even a bag strap.

The invention is therefore proposed in the first case to identify a passenger with reduced mobility or a passenger with a stroller to inhibit door closure by retaining the latter in an open state. In the second case (dog leash or bag strap traversing the door frame), the invention proposes to reopen the door after having prohibited the departure of the train in the case of public transportation.

To date, the safety related to the closure of doors is guaranteed by a sensitive edge which is capable of measuring a threshold pressure on an obstacle during door closing and therefore warning of the presence of the obstacle preventing complete closure. This edge is susceptible to two major defects: it is necessary to compress it so that the door reopens (this is highly disturbing in the case of a wheelchair or stroller caught in the doors) and its sensitivity is very often insufficient to detect the straps of a rucksack caught in closed doors for example (bag outside, passenger inside or vice versa). This type of scenario can therefore prove very dangerous when the train starts up. On driver-controlled subway trains, the driver is responsible for monitoring that these situations do not arise using visual means (video) and that after the doors have closed, nothing is obstructing the doors. In this case, human error is not entirely excluded. In the particular case of automatic public transportation systems such as driverless automated subway trains, the doors are managed automatically; the sensitive edges alone ensure safety as the doors are closing. Depending on the case, after the sensitive edges have detected an obstacle, the door reopens or only the mechanical force is eliminated for a short moment.

Other devices based on infrared beams exist, for example to manage elevator doors, but they are not used on subway trains because, in cases of high passenger footfall, it would be impossible to be able to close the vehicle doors.

BRIEF SUMMARY OF THE INVENTION

One aim of the present invention is therefore to maximize the safety level governed by an apparatus for automatically closing and opening at least one door in a frame, such as one or more platform screen doors of a public transportation vehicle, in particular if the latter is a vehicle without driver control or even driver presence.

To this effect, an apparatus is proposed according to the claims as well as advantageous use of said apparatus within the framework of public transportation.

A set of subclaims also presents the advantages of the invention.

From an apparatus for automatically closing and opening at least one door in a frame, said door being controlled by a controller guaranteeing a safety mode for retaining the door in an open state and, if need be, a door reopening mode in the event of an obstacle blocking the complete closure of the door into the frame, the invention is characterized in that the controller comprises:

- at least one camera having a line of sight at least intersecting the plane of the frame and providing an image of a space divided by the plane of the frame,
- at least one image analysis unit that isolates the regions of interest of an obstacle in the space,
- a calculator for extracting at least one geometric characteristic of each region of interest, for classifying the same into at least one closest category of different safety scenarios of known characteristics, and for outputting to the controller a safety signal which activates the safety mode and which is dependent on the evaluation of a safety alarm value calculated by a formula (such as an algorithm) in accordance with the category, using at least one weighting of dimensional criteria applied to the geometric characteristics.

Advantageously, the regions of interest may be geometric forms such as circles, squares, rectangles, bars. These are preferably selected very simply and according to very distinctive geometries, in order to facilitate and accelerate any closure to be avoided while guaranteeing a high safety level of geometric recognition.

In order to be able to maximize the desired safety level, provision is made to define the dimensional criteria from at least one of the following elements:

- absolute dimensional values of characteristics,
- relative dimensional values between characteristics,
- dimensional value ratios of characteristics based on a scenario.

These elements can be selected and supplemented after a learning phase based on numerous scenarios, or even by implementing a neural network.

The apparatus is characterized in that the line of sight is at least oblique in relation to the plane of the frame until it is vertical in the plane of the frame or slightly offset from the latter. This property is considered to provide improved safety vision of the regions of interest in the various aforementioned cases of danger. In order to be able to further improve the safety level, several cameras can be arranged with triangulated lines of sight. This makes it possible to ensure that a hidden area of an individual in danger will still be taken into account or will make it possible, during peak periods, to better identify an individual in danger among other individuals. Similarly, in the event of a camera fault, redundant safety protection is provided.

In the same way, the door frame may comprise a laser rangefinder connected to the controller as a second safety mode for retaining the door in an open state and, if need be, a door reopening mode. It is also possible to use additional means for retaining the door in an open state and, if need be, a door reopening mode which are connected to the controller, such as at least one door edge which is mechanically sensitive (normal or variable) to an obstacle or at least a light barrier traversing the plane of the door frame.

Finally, the apparatus according to the invention may provide that the calculator extracts dynamic characteristics of the regions of interest, which are classified into a category of known scenarios and the safety alarm value is calculated in a complementary way by safety criteria based on these dynamic characteristics, ideally by additional weighting in the formula based on the dimensional criteria. In this way, the characteristic movements of a person with reduced mobility or a bag strap can also improve danger detection and therefore ensure a better expected safety level.

The invention therefore provides that using the apparatus according to the invention ideally presents a high safety potential for automatic closing doors on public transportation vehicles, in particular driverless automatic vehicles. In addition, in order to be able to achieve a maximum safety level, the camera image can also be transmitted to a central control station either on board or on the ground, in particular in the case of a safety alarm. In this way, an operator can, in parallel to the apparatus according to the invention, observe in real-time a dangerous situation and the correct operation of said apparatus.

Examples of embodiments and applications are provided using the figures described below:

DESCRIPTION OF THE INVENTION

Figure 1:
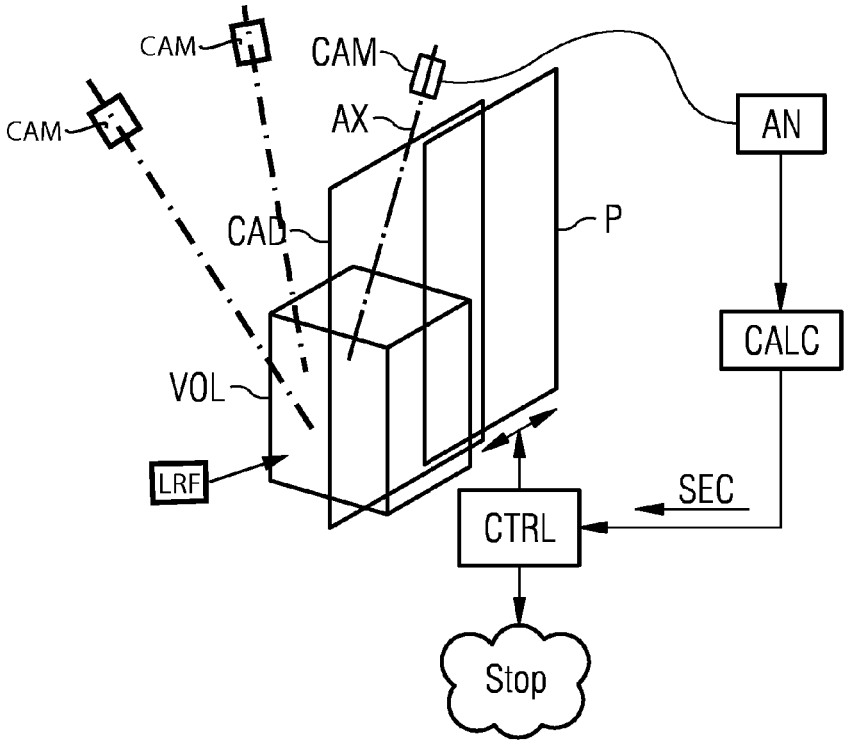
FIG. 1 Operating diagram of the apparatus according to the invention.

FIG. 1 presents a platform screen door P sliding into a frame CAD and equipped with an apparatus facilitating automatic opening and closing in its frame, said door being controlled by a controller CTRL providing a safety mode for retaining the door in an open state and, if need be, a door reopening mode in the event of an obstacle blocking the complete closure of the door into the frame.

The apparatus comprises:

- at least one camera CAM having a line of sight AX intersecting at least the plane of the frame CAD and providing an image of a space VOL divided by the plane of the frame,
- at least one analysis unit AN of the image that isolates the regions of interest of an obstacle in the space,
- a calculator CALC for extracting at least one geometric characteristic of each region of interest, for classifying the same into at least one closest category of different safety scenarios of known characteristics and for outputting to the controller a safety signal SEC which activates the safety mode and which is dependent on the evaluation of a safety alarm value calculated by a formula, in accordance with the category, using at least the weighting of dimensional criteria applied to the geometric characteristics.

In the case of a safety alarm (=signal SEC activated), the controller inhibits the closure of the door or reopens the door, and, of course, sends an immobilization signal STOP to the vehicle concerned.

Figure 2:
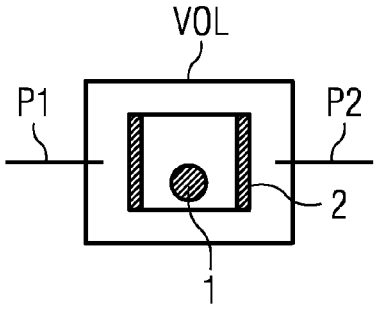
FIG. 2 Principle of the invention in the case of a wheelchair.

FIG. 2 presents an image captured from the top of the frame viewing downward for a first scenario where a person with reduced mobility (in a wheelchair) traverses the frame of platform screen doors P1, P2, while the doors are activated in closing mode. Shortly before and during the closure the camera at the top of the frame captures successive images and, in our case, through the usual means of image recognition extracts two main regions of interest: the head 1 of the person and the square shape 2 of his wheelchair (flanked by two wheels characteristic of two edges of the square). The calculator CALC then extracts a circle 1 and a square 2 and classifies this result in the "wheelchair" scenario category according to a first dimensional criterion "circle included in the square", using a 50% probability rate for example.

A second dimensional criterion can then also be extracted from respective dimensions of the two geometric characteristics 1, 2 (length, width, surface area) and, in the specific case, enables the previous probability to be increased by 20%. Finally, a third dimensional criterion can also be extracted from the surface ratio of geometric characteristics 1, 2, for example that the surface area ratio "square divided by circle" is greater than or equal to 3. In this way, using a weighting suited to each of these three criteria, it is possible to conclude that a probability of 80% is reached, which exceeds a predefinable threshold to activate the safety signal and inhibit closing or, if need be, reopen the door.

Figure 3:
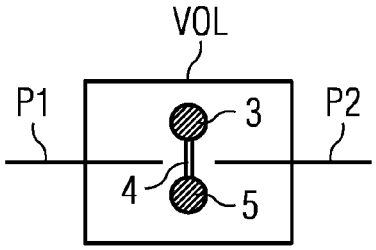
FIG. 3 Principle of the invention in the case of a bag strap or dog leash.

FIG. 3 presents, according to the same principle as FIG. 2, an image captured from the top of the frame viewing downward for a second scenario where a passenger has a dog on a leash and has not noticed that the dog has not followed him in or out of a vehicle while the two platform screen doors are about to close, are closing, or are even partly closed. The regions of interest are the head 3 (and/or the torso/shoulders) of the passenger as well as the torso and head 5 of the dog. A scenario of jammed leash/strap is then detected. Dimensional criteria are thus defined by applying characteristics of each of the regions of interest 3, 5 to the dimensions. If possible, a third region of interest 4 such as a leash or strap is sought, and reinforces another dimensional criterion. Additional criteria of the surface ratios between the geometric characteristics 3, 4, 5 can be calculated. Other dynamic dimensional criteria (movement due to panic/fear on the part of the dog or passenger) can be detected on the basis of movement of the geometric characteristics 3, 5 (and 4). Finally, a weighted formula for these criteria can also trigger a safety alarm if need be.

The invention is described below based on other aspects enabling the apparatus to be put into service in the case of automatic public transportation vehicles.

In addition to or as a complete replacement of sensitive on-board safety systems, the invention proposes to identify dangerous situations using several cameras CAM, possibly supplemented by a laser rangefinder LRF, installed around the door. When a dangerous scenario is identified while the vehicle is at the platform, depending on the type of scenario, the door will be kept open (in the case of persons with reduced mobility) or will be reopened to release the jammed object (straps caught in a door).

A camera or a network of cameras therefore surround the frame of the doors. The cameras are either on board the vehicle and film the exterior of the door or are on the platform, in particular when platform screen doors are present. The background image of the scene is perfectly known. The proposal is to implement automatic identification algorithms of the scenes used. The network of cameras may be used to obtain stereoscopic vision of the scene and to improve the reliability of detection by evaluating the space and the types of objects jammed for each region of interest. It is proposed to improve detection by adding a laser rangefinder. Merging the data from the cameras with that of the laser rangefinder is proposed in order to improve the quality of detection. The rangefinder will allow the precise location of the object to be established with considerably more accuracy and, combined with the information from the cameras, the space will be calculated with greater precision. If the apparatus according to the invention is used without edge-sensitive doors, processing systems will be introduced on board the cameras or the laser rangefinder in order to achieve at least the known level of safety SIL 3, namely a failure probability at least below 10-7 per hour. These processing systems will make it possible to check that the present detection system is always operational and that its performance is guaranteed.

In particular, a camera or a network of cameras surrounding a train door analyzes a scene occurring on the vertical plane of the door and located on the door sill. The choice of camera configuration is made according to the detection precision required for the regions of interest. In particular, in the case of a network of cameras, processing systems could be used to make it possible to comprehend the size of the shapes identified and improve the level of the safety function. These processing systems may be on board the camera(s) or may be cameras installed on dedicated equipment. The information from the camera(s) may be supplemented by information received from a laser rangefinder. The data is merged in order to precisely determine the position of the object (height and position in relation to the door plane) and its size. Three different processing systems may be implemented according to the function to be performed.

1. Detection of Persons with Reduced Mobility or of Strollers:

The cameras (and possibly the laser) analyze the scene. A reference image of various types of wheelchair or stroller is stored and known. When viewed from above, it is possible to see heads and a frame showing a free space at one location, or it is possible to see only the wheelchair (in the case of a wheelchair present alone in the door). Dimensional detection criteria (associated analysis unit and calculator) can then be defined. From this data, the space occupied by the wheelchair can be evaluated. Through correlation with the known spaces and identification of a head, we can consider that the scene is detected. This space is then localized in relation to the vertical plane of the doors. If the intersection of this space with the door plane is not empty, then we consider the scene to be active. In order to improve detection and to prevent false detections, the height of the objects is measured and their location in relation to the door plane is determined. These measurements are possible by knowing the position and optical characteristics of the camera(s) (and possibly of the laser rangefinder) used. The position of the cameras and the optical characteristics are also taken into account to identify the position of the objects in relation to the plane of the door. When the scene is declared active, a signal is sent to the system (=via the controller) managing the doors or the door to prevent the door from closing. When the door sill is no longer occupied by this type of scene, the device deactivates the signal sent, thereby no longer preventing closing.

2. Detection of an Object Caught Between the Doors

A bag with long straps, handles, belts with buckles or any other object attached to a person which may become jammed in the doors, can, while the doors are closing, be located outside the vehicle (or conversely, the person outside and the object inside) without the door system reopening. A case which is just as delicate involves a dog outside or inside the vehicle with the leash caught between the doors. This situation is dangerous if the vehicle were to start. When the doors are closed, the camera(s) analyze the vertical plane outside the door. A reference door plane is known by the system. The system, linked to the apparatus according to the invention, analyzes this plane as the door closes. An object is identified through image processing. In the case of a network of cameras (and laser rangefinder), the processing system will enable the shape, height and size of the object to be evaluated. A template defining the size and volume of the object is taken into account. If the object exceeds this template, the device, using criteria defined for the aforementioned characteristics, stops the train from leaving by sending a signal to the automated or traction control systems to inhibit departure. After this inhibitory signal, an opening order for the door concerned is controlled automatically in order to release the jammed object.

3. Automatic Reopening After a Person is Jammed

Where the doors are not equipped with sensitive edges, the camera(s) (and laser rangefinder) analyze the plane of the door. A jammed object is identified by a person caught between two sliding doors for example. The system detects the movement of the doors by analyzing the movement of the edges of the doors. When, as an additional criterion, the edges of the doors no longer move and have still not made contact together, the extent of the half-open position of the doors is analyzed. The height of the object, the size and its shape are taken into account in order to make a decision on whether to make the scene active. When the scene is active, a reopening safety command is sent to the door controller system. The door either immediately stops the closing force and reapplies the force after an adjustable time delay (for example 5 seconds) or it reopens completely. It is also possible to send the captured images to a train control center in order for an agent to confirm authorization to close or open the doors.

Ensuring the Safety of the Processing Systems.

When the safety function requires a safety level SIL3 (failure rate below 10-7 per hour), it is necessary to add functions to the cameras to ensure that the images come from the scene in real time and that the cameras are always operational.

Three types of processing operations are performed:

At least two cameras are used. The various images received from the cameras are correlated. Typically this makes it possible to identify whether a lens is obstructed, if the camera is no longer operating correctly and/or if the two cameras are oriented in the same direction. In order to improve the availability of the function, it is possible to switch to a network of 3 cameras in order to achieve redundancy and to always have at least two cameras in operation.

This first correlational analysis of camera images may be supplemented by testing the acquisition chain by injecting known test images of the door into each electronic device according to a determined sequence. If the images are received correctly by the processing unit, the acquisition chain can be considered to be still working correctly.

Image capture is synchronized by the time function of the system and any variation in the information transmission time will be detected. It is very important to manage this time in order to prevent any dangerous delay between the system and the analyzed scene. The response of the automatic door system linked to the apparatus according to the invention must always be compatible with the safety level of the public transportation system. If a predefined threshold is exceeded, the automatic door system will be considered faulty.

The invention claimed is:

1. An apparatus for automatically closing and opening at least one door in a frame, the apparatus comprising:

a controller controlling the door, said controller providing a safety mode for retaining the door in an open state, a door reopening mode, or both the safety mode and the door reopening mode in an event of an obstacle blocking a complete closure of the door into the frame;

at least one camera having a line of sight intersecting at least a plane of the frame and providing an image of a space divided by the plane of the frame;

at least one image analysis unit that isolates regions of interest of an obstacle in the space and being connected to said camera; and a calculator for extracting at least one geometric characteristic of each region of interest, for classifying the geometric characteristic into at least one category of different safety scenarios of known characteristics, and for outputting to said controller a safety signal for activating the safety mode and the safety signal being dependent on an evaluation of a safety alarm value calculated by a formula, in accordance with the category, using at least one weighting of dimensional criteria applied to the geometric characteristics, said calculator connected to said image analysis unit and to said controller, said calculator programmed to distinguish between a stroller, a wheel chair, a dog leash and a bag strap traversing the frame of the door.

2. The apparatus according to claim 1, wherein the regions of interest are geometric shapes.

3. The apparatus according to claim 1, wherein the dimensional criteria contain at least one of the following elements:

absolute dimensional values of characteristics;

relative dimensional values between the characteristics; and ratios of dimensional values of the characteristics based on the different safety scenarios.

4. The apparatus according to claim 1, wherein the line of sight of said camera is at least oblique in relation to the plane of the frame until the line of sight is vertical in the plane of the frame.

5. The apparatus according to claim 1, further comprising a laser rangefinder disposed on the frame of the door, said rangefinder connected to said controller as a second safety mode for retaining the door in the open state, the door reopening mode, or both the second safety mode and the door reopening mode.

6. The apparatus according to claim 1, further comprising a retaining device for retaining the door in the open state, the door reopening mode, or both the retaining device and the door reopening mode, said retaining device connected to said controller.

7. The apparatus according to claim 1, wherein said calculator extracts dynamic characteristics for the regions of interest, classifying the dynamic characteristic into a category of the different safety scenarios and the safety alarm value is calculated in a complementary manner by a safety criteria based on the dynamic characteristics.

8. The apparatus according to claim 1, wherein said calculator extracts dynamic characteristics for the regions of interest, classifying the dynamic characteristic into a category of the different safety scenarios and the safety alarm value is calculated in a complementary manner by a safety criteria based on the dynamic characteristics, by complementary weighting of a formula based on the dimensional criteria.

9. The apparatus according to claim 2, wherein the geometric shapes are selected from the group consisting of circles, squares, rectangles, and bars.

10. The apparatus according to claim 6, wherein said retaining device is selected from the group consisting of at least one door edge which is mechanically sensitive to an obstacle and at least one light barrier traversing the plane of the frame.

11. A method for controlling doors, which comprises the steps of:

providing an apparatus for automatically closing and opening at least one door in a frame, the apparatus containing:

a controller controlling the door, the controller providing a safety mode for retaining the door in an open state, a door reopening mode, or both the safety mode and the door reopening mode in an event of an obstacle blocking a complete closure of the door into the frame;

at least one camera having a line of sight intersecting at least a plane of the frame and providing an image of a space divided by the plane of the frame;

at least one image analysis unit that isolates regions of interest of the obstacle in the space and connected to the camera;

a calculator for extracting at least one geometric characteristic of each region of interest, for classifying the geometric characteristic into at least one category of different safety scenarios of known characteristics, and for outputting to the controller a safety signal for activating the safety mode and the safety signal being dependent on an evaluation of a safety alarm value calculated by a formula, in accordance with the category, using at least one weighting of dimensional criteria applied to the geometric characteristics, the calculator connected to the image analysis unit and the controller, the calculator programmed to distinguish between a stroller, a wheel chair, a dog leash and a bag strap traversing the frame of the door; and using the apparatus for automatically closing doors of a public transportation vehicle.

12. The method according to claim 11, which further comprises installing the apparatus on driverless automatic vehicles.

13. The method according to claim 11, which further comprises sending the image to a central control station which is on board the public transportation vehicle or on ground, including in a case of a safety alarm.

14. The method according to claim 11, which further comprises sending a camera image to a central control station which is on board the public transportation vehicle or on ground when a safety alarm occurs.

* * * * *